United States Patent [19]

White, Jr.

[11] 4,354,659

[45] Oct. 19, 1982

[54] LIGHT WEIGHT INGOT MOLD MAT

[75] Inventor: Herbert A. White, Jr., Churchill Borough, Pa.

[73] Assignee: American General Supply Company, Pittsburgh, Pa.

[21] Appl. No.: 194,372

[22] Filed: Oct. 6, 1980

[51] Int. Cl.[3] ..... B22D 7/12

[52] U.S. Cl. ..... 249/206; 164/133; 164/412; 249/204

[58] Field of Search ..... 164/59.1, 133, 137, 164/412; 249/206, 204, 174

[56] References Cited

U.S. PATENT DOCUMENTS

| | | | |
|---|---|---|---|
| 2,907,083 | 10/1959 | Shakely | 249/174 |
| 2,910,747 | 11/1959 | Sterick et al. | 249/206 |
| 4,135,589 | 1/1979 | Hammerton | 164/137 X |
| 4,209,162 | 6/1980 | Petiau | 164/412 X |

FOREIGN PATENT DOCUMENTS

| | | | |
|---|---|---|---|
| 415031 | 8/1934 | United Kingdom | 164/133 |

*Primary Examiner*—Gus T. Hampilos
*Assistant Examiner*—J. Reed Batten, Jr.
*Attorney, Agent, or Firm*—Martin J. Carroll

[57] ABSTRACT

A light weight ingot mold mat for receiving molten metal is formed from sheets of metal compatible with the molten metal. The sheets have closely spaced holes therein throughout most of their area so that they are very light and easily crumbled to form a honeycombed structure. The mat is placed on the mold stool and absorbs the force of the molten metal and chills it so that it freezes sufficiently to seal the joint between the stool and mold. The mat is melted and absorbed into the ingot.

9 Claims, 6 Drawing Figures

LIGHT WEIGHT INGOT MOLD MAT

This invention relates to apparatus for pouring metal into an ingot mold and more particularly to the top pouring of steel into a mold mounted on a stool. In this operation several problems are present. The force of the stream of molten metal falling on the stool erodes the stool. There may be leakage of metal into the joint between the mold and stool. Splashing of the metal against the sides of the mold is detrimental. Various methods have been used in an attempt to solve these problems, but none have been entirely successful. To prevent stool erosion mats of various types have been used. One such steel mat is shown in Schmertz et al U.S. Pat. No. 2,743,493 dated May 1, 1956. Steel mats may be solid or made of wound strip or the like. In every case of which I have knowledge the steel mats are not melted, but must be removed from the ingot or subsequent slab or billet. Such mats are heavy and thus difficult to handle and relatively expensive to make. The yield is also reduced. Schmertz et al provide vertical openings in their mat which reduce its weight somewhat, but clearly not by as much as 50% so that it is still very heavy. Also the straight through vertical openings may result in molten metal passing through. It is doubtful that use of this mat results in sealing of the joint between the stool and mold. Other mats are made of refractory material or consumable material such as cardboard. These result in ingot contamination and in many cases give little protection to the stool and do not seal the joint between the stool and mold. It has been suggested to use a mat which extends into the joint between the mold and stool. This increases the cost of the mat and also increases the labor cost of installation. Various type seals have been used as a seal for this joint, but these too increase material and labor costs. Mold coatings of various types have been used to protect the mold wall from splashing, but this is an expensive operation.

Contrary to prior art teachings I have found that improved results can be obtained by using a very light honeycombed or spongelike steel mat which is melted and absorbed into the ingot. These results include protection of the stool, or in case of a mold having an integral bottom, protection of the bottom surface; sealing of the joint between the mold and stool, and reduction of splashing.

It is therefore an object of my invention to provide an ingot mold mat which is light, easy to handle, and inexpensive to make.

Another object is to provide such a mat which protects the top of the stool and results in sealing of the joint between the mold and stool.

These and other objects will be more apparent after referring to the following specification and attached drawings in which FIG. 1 is a perspective view of a sheet from which the mat is formed;

Figure 1:
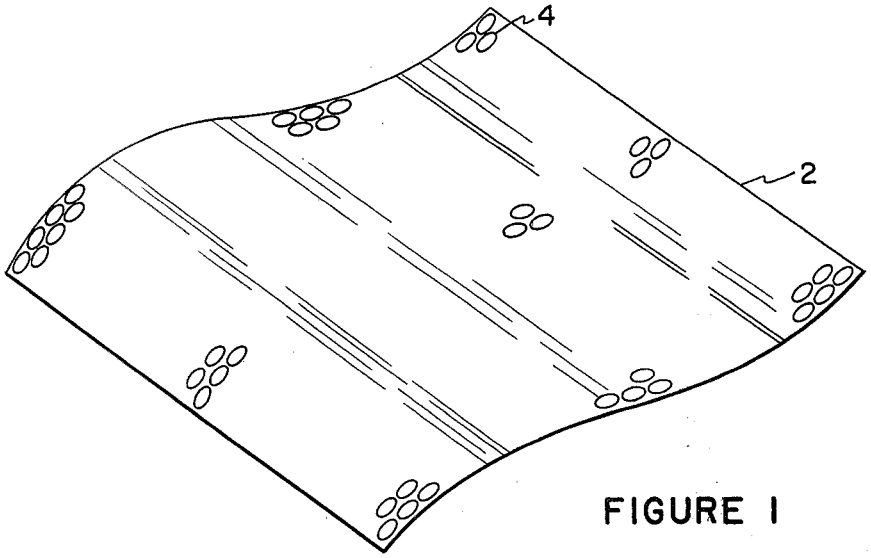

Referring more particularly to the drawings reference numeral 2 indicates a thin metal sheet having closely spaced holes 4 therein. While only several holes 4 are shown in the drawings it will be understood that they are present over substantially all its surface. Since most of the metal has been removed this results in a very light weight sheet which may be easily bent and handled almost like cloth. A plurality of these sheets are used to make mat 6 of my invention. The sheets 2 are crumbled and intermeshed to form a honeycombed structure with random voids. The exact manner in which this is done has little importance, but they cannot be laid flat one on top of the other since this would give a solid and not a honeycombed or spongy structure.

Figure 2:
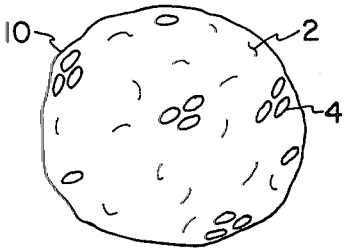
FIG. 2 is a view of a bundle formed from a number of sheets shown in FIG. 1.
Figure 3:
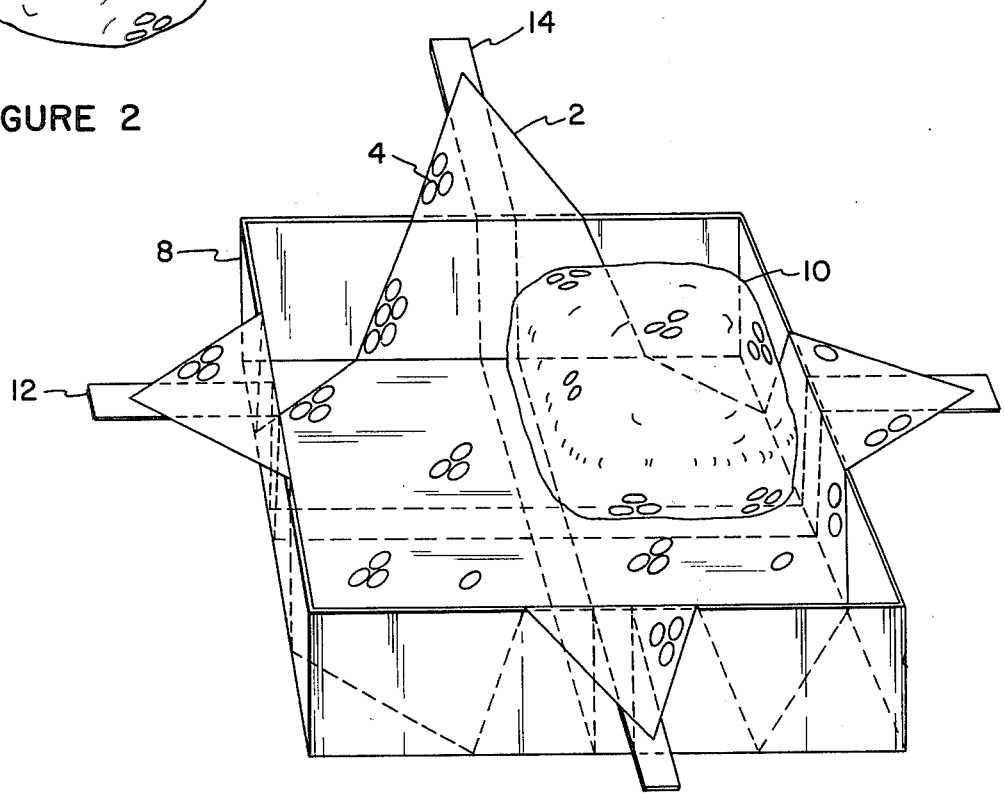
FIG. 3 is a perspective view of a step in the manufacture of a mat.
Figure 4:
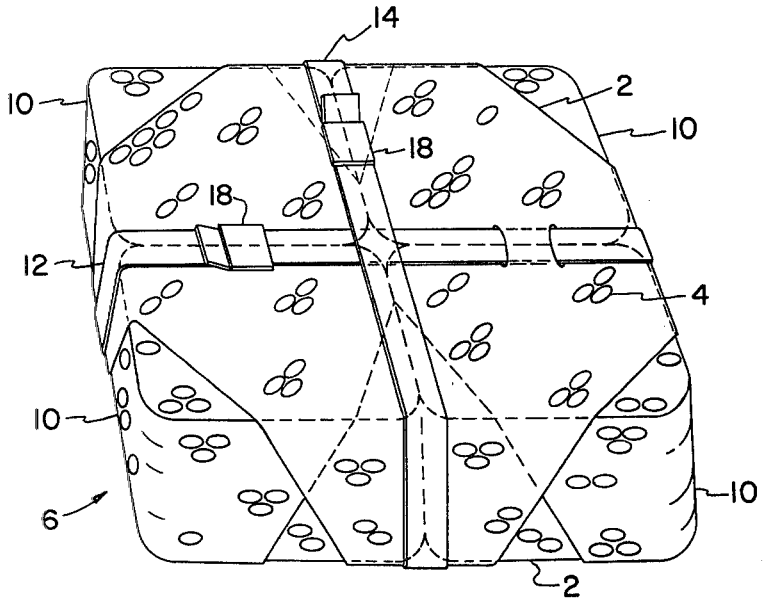
FIG. 4 is a perspective view of a completed mat.
Figure 6:
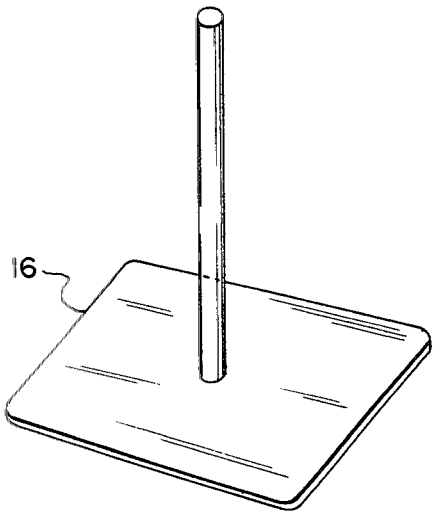
FIG. 6 is a view of a tool used in making the pad.

One particular method of making a specific mat will be described. It will be understood that there are many sizes and shapes of ingot molds some of which have integral bottoms and others of which rest on stools. While my invention may be used with any type of mold it is particularly advantageous with those having stools and the making of a mat for such use in a 71 cm. by 81 cm. mold for casting steel will be described. A box 8 of approximately that size and about 30 cm. deep is provided. Sheets 2 of 1010 tin free steel 91 cm.×91 cm.×0.066 cm. thick are provided having closely spaced 3.5 cm. holes arranged in a staggered pattern are provided. One sheet is wrapped into a ball and second, third and fourth sheets are then wrapped successively around the outside of the ball to form a bundle 10 as shown in FIG. 2. This operation is repeated to form additional bundles. Two bands 12 and 14 of similar steel are then placed symmetrically in crossed relationship on the bottom of box 8 with their ends extending up and above the sides of the box. A sheet 2 is then placed in box 8 on top of the bands with its corners approximately in the centers of the sides of the box and bent upwardly. Four bundles 10 are then placed on top of the sheet 2 in the box and a workman stamps the bundles 10 downwardly with a tool 16 having a flat bottom so that the assembly of sheets in the box is approximately the same thickness throughout, but in a very porous or spongy condition. The material is then lifted from the box 8 by gripping the bands 12 and 14 and placed on the floor. The straps or bands 12 and 14 are passed through some of the holes in the bottom sheet and a flat sheet 2 is placed on top of the assembly. The ends of the top and bottom sheets are bent over the assembly and bands 12 and 14 passed through holes in the top sheet. The ends of each of the bands 12 and 14 are then connected with clips 18 in the usual manner, thus completing the mat 6. This results in a mat approximately 12.7 cm. thick weighing approximately 6.35 kilograms. A solid piece of steel of this size would weigh approximately 570 kilograms.

Figure 5:
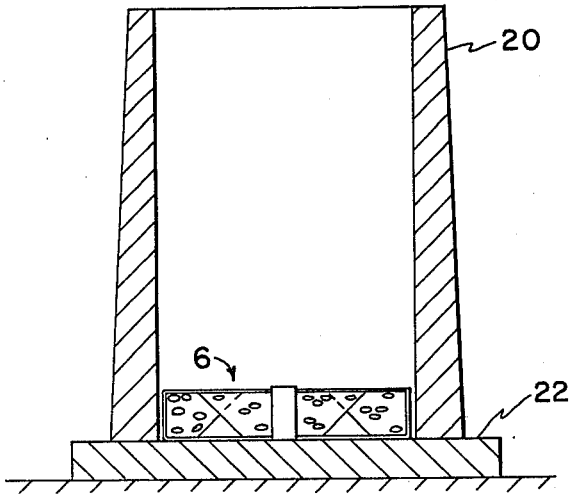
FIG. 5 is a view, partly in section,, of a mat in a mold.

In use, the mat 6 held by the straps 12 and 14 is lowered into a mold 20 and rests on top of stool 22 as shown in FIG. 5. As molten metal is poured into the mold the mat absorbs the force of the molten stream and chills the steel so that it freezes sufficiently to seal the joint between the mold 20 and stool 22. The steel of the mat quickly melts and is absorbed into the ingot, thus losing its identity so that it need not be removed. Splashing of the mold wall is also greatly reduced.

The invention may be used in the pouring of other metals, it only being necessary that the metal of the pad be compatible with the metal being poured.

It will be understood that the manner in which the sheets may be crumbled may vary, but in all instances a honeycombed structure will be formed. While it is preferred that the mat be made from a plurality of sheets it could be made of a single long sheet. The bands 12 and 14 are useful for handling purposes, but are not necessary to the operation of the mat.

Because of the great variety in mold height and cross section the size of the mats may vary to a large extent. However, to insure proper fool proof operation it is preferred that the mat have a minimum thickness of approximately 5 cm. and that it cover all but 5 cm. around the periphery of the mold although it is only necessary that it cover the area impinged on by the falling molten metal. The upper limit of mat thickness is limited only to such extent that the amount of metal can be melted and absorbed into the ingot. The extent of the voids in the mat may vary greatly, but must not be less than 90% so that its total weight will not exceed 10% of solid metal of the same size. Preferably the weight should not exceed 1% of solid metal of the same size. In most cases the voids will exceed 90%, but sufficient metal will be present so that there will be no direct vertical path therethrough. All of these factors can be readily determined for particular conditions by means of a few trials which may be made while obtaining usable ingots.

While one specific embodiment has been shown and described other modifications and adaptations may be made within the scope of the following claims.

I claim:

1. A light weight ingot mold mat for receiving molten metal comprising a plurality of crumbled thin sheets each made from a metal compatible with the molten metal and having closely spaced holes therein throughout substantially all its surface, said sheets being arranged in a plurality of layers arranged to define a honeycombed spongelike structure of considerable thickness defining a plurality of discontinuous voids, and substantially flat individual thin sheets arranged on the top and bottom of said spongelike structure to form an assembly, said top and bottom sheets being made from a metal compatible with the molten metal, none of said discontinuous voids extending from the top sheet to the bottom sheet.

2. An ingot mold mat according to claim 1 in which said molten metal is steel and said sheets are tin free steel.

3. An ingot mold mat according to claim 1 having at least 90% voids therein.

4. An ingot mold mat according to claim 1 in which said top and bottom sheets each have closely spaced holes therein throughout substantially all its surface.

5. An ingot mold mat according to claim 1 in which several of said crumbled sheets are bundled together with additional sheets being wrapped around each individual bundle, said bundles being arranged between the top and bottom sheets and flattened into a somewhat uniform structure.

6. In ingot mold mat according to claim 4 including a first strap wrapped around the outside of said assembly and passing through at least one hole in each of the top and bottom sheets, and a second strap wrapped around the outside of said assembly generally at right angles to the first strap and passing through at least one hole in each of the top and bottom sheets, said straps being made of a metal compatible with the molten metal.

7. An ingot mold mat according to claim 5 in which said top and bottom sheets each have closely spaced holes therein throughout substantially all its surface.

8. An ingot mold mat according to claim 7 including a first strap wrapped around the outside of said uniform structure and passing through at least one hole in each of the top and bottom sheets, and a second strap wrapped around the outside of said uniform structure generally at right angles to the first strap and passing through at least one hole in each of the top and bottom sheets, said straps being made of a metal compatible with the molten metal.

9. An ingot mold mat according to claim 7 in which said molten metal is steel and said sheets are tin free steel.

* * * * *